US007040379B2

(12) United States Patent
Kapaj et al.

(10) Patent No.: US 7,040,379 B2
(45) Date of Patent: May 9, 2006

(54) METHOD AND APPARATUS FOR THE REGULATION OF STRIP TEMPERATURE IN A CONTINUOUS METALLIC STRIP CASTING PLANT

(75) Inventors: Nuredin Kapaj, Udine (IT); Francesco Drius, Cervignano del Friuli (IT); Andrea Bonera, Palmanova (IT); Alfredo Poloni, Fogliano Redipuglia (IT)

(73) Assignee: Danieli & C. Officine Meccaniche S,p.A., Buttrio (IT)

( * ) Notice: Subject to any disclaimer, the term of this patent is extended or adjusted under 35 U.S.C. 154(b) by 0 days.

(21) Appl. No.: 10/520,720

(22) PCT Filed: Jul. 8, 2003

(86) PCT No.: PCT/EP03/07302

§ 371 (c)(1),
(2), (4) Date: Jan. 6, 2005

(87) PCT Pub. No.: WO2004/007118

PCT Pub. Date: Jan. 22, 2004

(65) Prior Publication Data

US 2005/0241798 A1 Nov. 3, 2005

(30) Foreign Application Priority Data

Jul. 10, 2002 (IT) ..... MI2002A1512

(51) Int. Cl.
*B22D 11/124* (2006.01)
*B22D 11/22* (2006.01)

(52) U.S. Cl. ..... 164/455; 164/414; 164/444; 164/486

(58) Field of Classification Search ..... 164/455, 164/486, 414, 444
See application file for complete search history.

(56) References Cited

U.S. PATENT DOCUMENTS 5,454,417 A 10/1995 Rosenstock
6,585,030 B1 * 7/2003 Strezov et al. ..... 164/455

FOREIGN PATENT DOCUMENTS

| | | |
|---|---|---|
| EP | 0 540 610 B2 | 5/1993 |
| EP | 0 707 908 B1 | 4/2004 |
| JP | 56 119607 | 9/1981 |
| JP | 63 049350 | 3/1988 |
| JP | 08 039222 | 2/1996 |

* cited by examiner

*Primary Examiner*—Kuang Y. Lin
(74) *Attorney, Agent, or Firm*—Stetina Brunda Garred & Brucker

(57) ABSTRACT

A method, and the related implementation device, for the regulation of strip temperature in a continuous metallic strip casting plant, wherein such temperature regulation begins on the strip whilst under the casting equipment and at a certain distance from it, and then continues along the roll path. The device provides that the rolls on which the strip is transported are fitted with a cooling system.

12 Claims, 2 Drawing Sheets

METHOD AND APPARATUS FOR THE REGULATION OF STRIP TEMPERATURE IN A CONTINUOUS METALLIC STRIP CASTING PLANT

FIELD OF THE INVENTION

The present invention relates to a method for regulation strip temperature in a continuous metallic strip casting plant, and to the related apparatus. More precisely, the present invention relates to temperature control and regulation of a continuously cast strip in the entire section comprised between the exit from the crystallising rolls and the coiling station.

STATE OF THE ART

Metallic strips are normally produced from ingots or continuously cast slabs, which are reduced in thickness with a series of successive operations comprising the breakdown, hot lamination and cold lamination, together with further intermediate operations, for example thermal treatment. These operating methods require very expensive plants and considerable energy consumption.

Hence, since long the tendency is that of reducing plant and operating costs by casting products with a thickness as close as possible to that of the final product; consequently, following the introduction of continuous slab casting, the thickness of the latter is reduced from the conventional 200–300 mm to 60–100 mm obtained in the so-called "thin slab casting". However, even the passage from 60 mm to 2–3 mm, which is the typical thickness of a hot strip, requires a series of energy demanding steps.

In view of the inherent disadvantages in casting strips of significant thickness for reduction to thin strips, the advantages in directly casting metallic strips have been recognised since the second half of the $19^{th}$ century, when Sir Thomas Bessemer patented a machine for the continuous casting of steel strip consisting of counter rotating, cooled metallic rolls placed a small distance apart; the metal was cast in the gap between the rolls, solidified upon contact with the cold walls of the latter and finally extracted with a thickness equal to the gap between the rolls themselves.

Such extremely attractive technology has found practical uses for the casting of metals such as copper and aluminium only in the last decades of the $20^{th}$ century, whilst for metals and alloys with high melting point, such as steel, at present there has been no real industrial usage of such technology.

Efforts are being made in this field essentially to reduce production costs, energy consumption and environmental impact, and to produce thin strips usable as such, in particular applications in which for example surface quality is not a particular requirement, or to be considered the same as the hot rolled strips for these uses in which thicknesses of less than a millimeter are necessary.

Being established that the machine conceived by Bessemer in his time is still, in its general form, the most ideal for continuous metallic strip casting, the problems to solve for its effective use are very numerous and range from ensuring the maintenance of the position of the rolls in correspondence to their facial plane, to the most suitable materials to survive the demanding working conditions, to the automated control of all the operations and the casting speed and drawing of the strip, up to its coiling. Naturally, the integrity of the strip between casting and coiling is an important problem.

Regarding the strip integrity, to avoid that differences in speed between the cast rolls and the coiling station, or the roll stand, in the case that there is a roll stand downstream of the casting prior to coiling, can lead to tearing, it is proposed that the strip exiting from the casting ingot mould itself is made to hang freely under the ingot mould itself, and is then raised up, forming a curve or "loop", by drawing rolls and then be conveyed, supported by rolls forming a rolling conveyor, to the coiling. Upon the variation of speed of the rolls of the ingot mould or of the coiling mechanism, the length of the loop varies, without imposing further tensions on the strip, enabling the control and regulation means to compensate for said variations in speed.

Furthermore, specific insulation, heating or cooling means are provided near to the roll conveyor to control and regulate the temperature of the strip, in particular to make it uniform.

EP 0 540 610 describes a method, and the related plant, for temperature control of a metallic strip in a casting plant of the type mentioned above, in which molten metal is cast into the existing gap between two counter rotating rolls making up an ingot mould to cast a strip, the strip is extracted from such a gap, left to hang freely underneath and drawn back upwards so as to form a loop; then the strip is made to pass between two rotating rolls of a dragging, drawing system and towards a temperature control area, located horizontally with respect to the exit from the ingot mould.

In the published Japanese application JP-A-56-119607 there is disclosed the production of metallic strip in a casting plant with cooled counter rotating rolls in which the metal, after having been solidified upon contact with said rolls, is brought to the desired dimensions, width and thickness, whilst continuously fed, by means of a speed regulation device towards a reheating oven and then wound into a coil.

The published Japanese application JP-A-63-49350 describes a metallic strip production process, in particular for materials such as permalloy having low ductility, in a plant of the type mentioned above in which the strip produced is made to pass through a cooling area and then wound into a coil.

As can be seen, such known technique refers essentially to cooling/heating treatments carried out in particular near to the roll conveyor on which the strip moves towards the coiling device.

SUMMARY OF THE INVENTION

According to the present invention these inconveniences are obviated by controlling the cooling of the strip in an area at a predetermined distance from the ingot mould, downstream of it, on the rolling conveyor.

DETAILED DESCRIPTION OF THE INVENTION

The method according to the present invention, in a continuous metal casting plant in which liquid metal is poured into an ingot mould preferably comprising a pair of cooled, counter rotating rolls, solidifies upon contact with said rolls and extracted from the ingot mould in the form of a high temperature strip, said strip following, below said ingot mould, a path, at first descending and then climbing, forming in such a manner a loop, passing then on a roll conveyor with cooled rolls, pulled by at least a pair of drawing rolls, and is then wound into coils by a coiling mechanism, comprises the operations of: (i) controlling and regulating the amount of heat exchanged with the environment by the strip which forms the loop (ii) controlling and regulating the amount of cooling fluid fed to said rolls in the roll conveyor, (iii) controlling and regulating position of further cooled rolls positioned above the strip in the roll conveyor from a position in which they are detached from the strip to a position in which they are in contact with the strip, (iv) recording the signals from an array of temperature sensors placed along the strip between the exit from the ingot mould and the entrance to said coiling mechanism, and (v) sending said signals to an electronic computing device, which computes the data received and accordingly regulates the steps from (i) to (iii).

The amount of heat exchanged with the environment by the strip which forms the loop can be regulated by varying the length of the loop itself.

Another way to regulate said amount of heat is that of using jets of inert gas directed towards the descending side of the loop.

It can also be useful to control and regulate the distance between the strip sections, descending and ascending, of the strip which forms the loop, to have a greater possibility to regulate the exchange of heat between the loop and the environment.

As a further implementation of the method, the loop itself may be insulated with respect to the external environment by means of insulating materials, forming a well. In this regard, the well can be made of thermally insulating walls placed parallel to the faces of the strip which forms the loop.

The apparatus to carry out the method according to the present invention comprises a strip temperature control system characterised by the fact of comprising means for controlling and regulating the amount of heat exchanged towards the environment by the strip which forms the loop, means for controlling and regulating the amount of cooling fluid in said rolls making up the rolling conveyor, means for controlling and regulating the position of further rolls placed above the strip in said roll conveyor, between a position detached from the strip and a position in contact with the strip itself, means for controlling the temperature positioned downstream of said ingot mould, between said loop and said coiling device; means for processing the data originating from said temperature control means and for controlling separately each of said control and regulation means.

The amount of heat exchanged towards the exterior by the strip which forms the loop is regulated by changing the length of the loop itself, by changing the rotational speed of the cast rolls and of the drawing rolls acting on the strip on the rolling conveyor.

In addition to controlling and regulating the loop length it is preferable to provide also means for regulating and controlling the distance between the descending and ascending sections of the strip in the loop itself.

The device according to the present invention will now be described with particular reference to one embodiment, which is shown by way of a non limiting example with help of the attached drawings in which.

Figure 1:
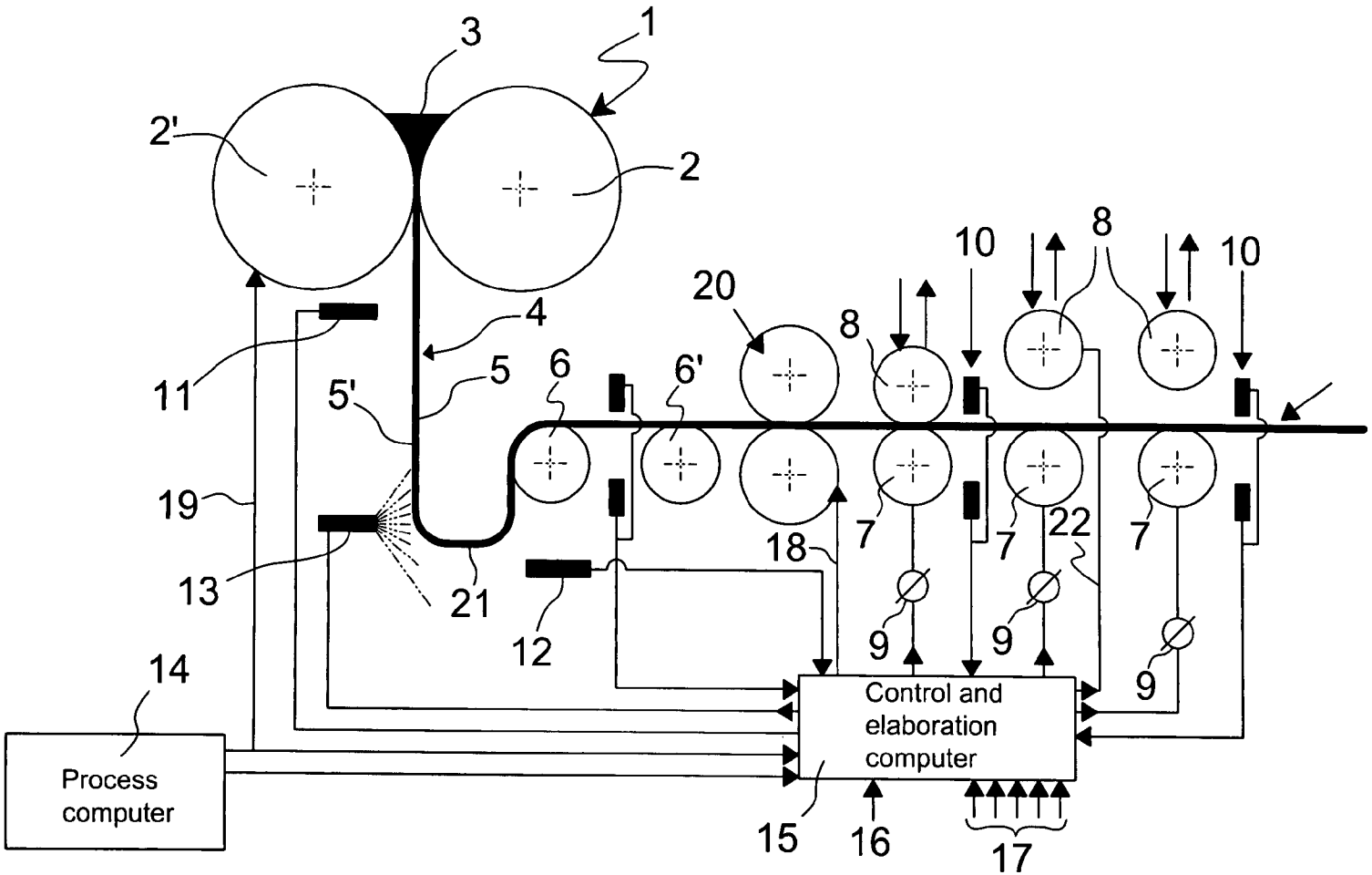
FIG. 1 shows a general layout of the plant.

With reference to FIG. 1, there is shown an ingot mould 1 comprising two cooled, counter rotating cast rolls 2 and 2' between which liquid metal 3 is poured which solidifies upon contact with the facing walls of said rolls 2 and 2' and is extracted as a strip 4, with faces 5 and 5'.

Exiting from the rolls 2, 2' the strip 4 hangs freely in a first section in which it moves downwards and is then drawn upwards to pass about a first roll 6 and above a second roll 6' which make up the initial parts of a roll conveyor comprising additional rolls 7 on which the strip is supported whilst moving, moved by drawing rolls 20.

Figure 2:
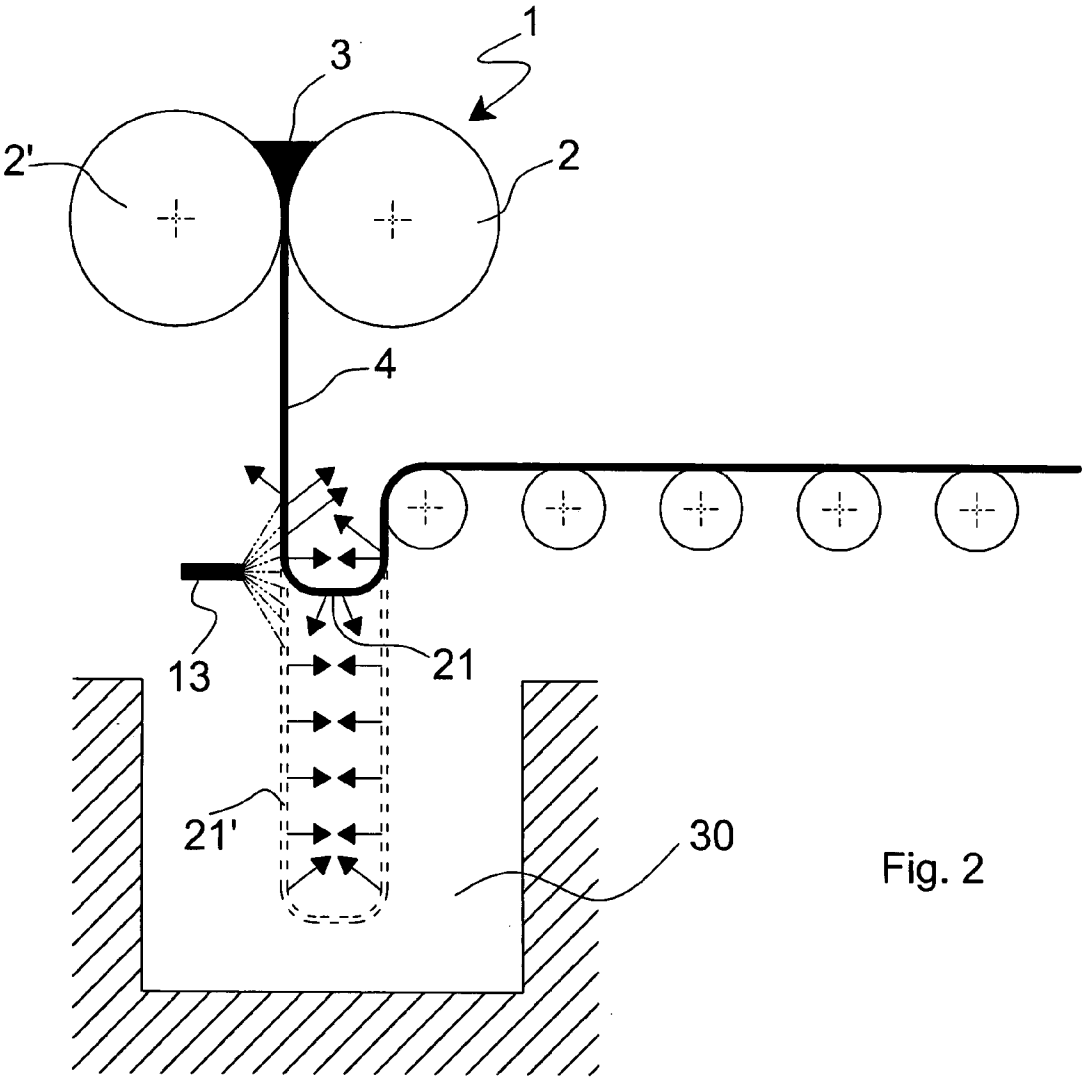
FIG. 2 shows a layout of the part of the plant between the ingot mould and the roll conveyor, indicating a variation of the loop length.

The strip 4, then, in passing through the cast rolls 2, 2' to the roll 6 forms a loop 21 of variable length as shown in FIG. 2. The function of said loop, according to the present invention, is to limit the heat exchange between the strip and the environment simply by varying the surfaces of the strip facing each other in the descending and ascending sections of the loop itself.

Additionally, as illustrated in FIG. 2, a well 30 of thermally insulating material may be provided under the ingot mould 1. The well 30 may consist of thermally insulating walls placed parallel to the descending and ascending sections of the strip 4 which forms the loop 21.

The regulation of the coiling temperature of the strip, in a coiling plant, not shown in the figures, downstream of the roll conveyor, essential in many cases for obtaining specific characteristics in the final strip itself, is made by means of supporting rolls 7 of the roll conveyor, appropriately cooled; if such rolls are insufficient, additional rolls 8 are used, which are placed above the strip 4 on the roll conveyor, these also being cooled and movable in the direction of the respective arrows, from a rest position detached from the strip 4 to an operative lowered position, in contact with the strip itself.

The above mentioned functions for limitating heat exchange of the strip in the loop 21 and the cooling of the strip on the roll conveyor are controlled by temperature sensors, respectively 11 and 10, which send the measurements made to a control and processing computer 15 which controls, on the one hand, the rotational speed of the rolls 20, through the command line 18, modifying the length of the loop 21, which is monitored by the sensor 12, and on the other hand, the amount of cooling fluid in the rolls 7, by means of the regulation valves 9. Ccooling by means of the rolls 7 is controlled by measuring the entry and exit temperature of the cooling fluid in the rolls, and sending them to the computer 15 through lines 16 and 17 respectively.

A further possibility for the cooling of the strip on the roll conveyor is given by the upper rolls 8, the position of which is controlled, by the computer 15 which as a result of the information obtained from the sensors 10 actuates the lowering, or the raising, of one or more of the rolls 8.

The computer 15, as a result of the information received from the temperature sensor 11 and position sensor 12 relative to the strip which forms the loop 21, as well as the rotational speed of the drawing rolls 20, acts on the one hand, to alter the rotational speed of the crystallising rolls 2, 2', thus varying the casting speed, through the line 19, and on the other hand, to initiate and to alter further cooling of the strip in the loop through an inert gas distributor 13.

A process computer 14 controls the operation of the entire plant.

In FIG. 2, in which parts corresponding to these of FIG. 1 are indicated with the same numerals, there are shown two possible loop lengths. In the first, the loop 21 is very short and therefore both faces of the strip, the inside and outside of the loop, irradiate towards the environment thereby maximising the heat exchange with the environment itself; in the second, the loop 21' is much longer and therefore the internal walls of the strip irradiate towards each other, with a reduced heat exchange towards the exterior. Both situations are illustrated by arrows.

Furthermore, in the case where inert cooling gas must be used, which is emitted from the distributor 13, in the case of the short loop one sees that the cooled surface is somewhat less than in the case of the long loop.

The invention claimed is:

1. Method for temperature control of a high temperature metallic strip in a continuous metal casting plant wherein liquid metal is poured into an ingot mould consisting of a pair of cooled, counter rotating rolls, solidifies upon contact with said rolls and is extracted from the ingot mould in the form of a high temperature strip, said strip following, below said ingot mould, a free path, firstly descending and then ascending forming, in such a manner a loop, passing then on a roll conveyor with cooled rolls, drawn by at least a pair of drawing rolls, and is then wound into coils by a coiling device, characterised by the stages of:

(i) controlling and regulating the heat exchange towards the environment by the strip which forms the loop, (ii) controlling and regulating the supply of cooling fluid fed to said rolls in the roll conveyor, (iii) controlling and regulating the heat exchange with a series of rolls put into contact with the strip above it, (iv) recording the signals from an array of temperature sensors placed along the strip between the exit from the ingot mould and the entrance into said coiling device, and (v) sending said signals to an electronic computing device, which computes the data received and accordingly regulates the stages from (i) to (iii).

2. The method according to claim 1, wherein the heat exchange between the strip which forms the loop and the environment is regulated by modifying the length of the loop itself.

3. The method according to claim 1, wherein the position of additional cooled rolls placed above the strip in the roll conveyor is controlled and regulated from a position wherein they are detached from the strip to a position wherein they are in contact with the strip.

4. The method according to claim 1, wherein the heat exchange towards the environment of the strip which forms the loop is regulated by varying the distance between the descending and ascending sections of the strip, of the loop itself.

5. The method according to claim 1 wherein the loop itself is insulated with respect to the external environment by means of insulating materials, forming a well.

6. The method according to claim 5 wherein said well can be made of thermally insulating walls placed parallel to the faces of the strip which forms said loop.

7. A strip temperature control system comprising:

means for controlling (11) and regulating (13, 18, 19) heat exchange towards the environment of the strip (4) which forms a loop (21);

means for controlling (16, 17) and regulating (9) cooling fluid supply to said rolls (7) constituting a roll conveyor;

means for controlling (10) and regulating (22) the position of additional rolls (8) placed above the strip in said roll conveyor, between a position detached from the strip and a position in contact with the strip itself, and further for controlling the temperature at positions downstream of said loop (21); and means (14, 16) for computation of the data originating from said means of temperature control and for separate control/command of each of said controlling and regulating means.

8. The system according to claim 7, comprising means for controlling (10) and regulating (15) the position of additional rolls (8) placed above the strip in said roll conveyor, between a position detached from the strip and a position in contact with the strip itself.

9. The system according to claim 7, comprising means (15) for variating the rotational speed of the crystallising rolls (2, 2') and the rotational speed of the drawing rolls (20) to regulate the length of the loop.

10. The system according to claim 7, comprising means for the variation of distance between the descending and ascending sections of the strip which forms the loop.

11. The system according to claim 7, wherein a well of thermally insulating material is provided under the ingot mould.

12. The system according to claim 11, wherein said well consists of thermally insulating walls placed parallel to the descending and ascending sections of the strip which forms the loop.

* * * * *